United States Patent [19]

Fujikura et al.

[11] 4,101,347

[45] Jul. 18, 1978

[54] FERRITE-AUSTENITE STAINLESS STEEL CASTINGS HAVING AN IMPROVED EROSION-CORROSION RESISTANCE

[75] Inventors: Masakuni Fujikura; Tomio Kono; Kazuto Terai, all of Nagoya; Naohiro Abe; Kiyohito Ishida, both of Chita, all of Japan

[73] Assignee: Daido Tokushuko Kabushiki Kaisha, Nagoya, Japan

[21] Appl. No.: 794,334

[22] Filed: May 6, 1977

[51] Int. Cl.[2] ..... C22C 38/42

[52] U.S. Cl. ..... 148/38; 75/125; 75/128 R

[58] Field of Search ..... 148/37, 38; 75/128 R, 75/128 W, 125

[56] References Cited

U.S. PATENT DOCUMENTS

| | | | |
|---|---|---|---|
| 3,337,331 | 8/1967 | Ljungberg | 75/128 W |
| 3,567,434 | 3/1971 | Richardson et al. | 75/125 |
| 3,785,787 | 1/1974 | Yokota et al. | 148/37 |

FOREIGN PATENT DOCUMENTS

| | | | |
|---|---|---|---|
| 47-8,689 | 3/1972 | Japan | 75/125 |

OTHER PUBLICATIONS

Metals Abstracts, Sep. 1971, p. 1327, Abstract #35-1078.

*Primary Examiner*—Arthur J. Steiner
*Attorney, Agent, or Firm*—Fleit & Jacobson

[57] ABSTRACT

Ferrite-austenite stainless steel castings having an improved erosion-corrosion resistance consist by weight percentage of not more than 0.1% of C, 0.2–3% of Si, not more than 2% of Mn, 2.2–4% of Cu, 3–9% of Ni, 20–30% of Cr, 2–6% of Mo, 0.08–0.25% of N, 0.12–0.3% of Sn, at least one of 0–2% of Nb, 0–1% of Ti, 0–2% of Ta, 0–1% of Zr and 0–1.5% of V and remainder of Fe, and are obtained by solution heat treatment at 1,000°–1,150° C in such a manner that Cr- and Ni-equivalents lie within an area represented by the area ABCD shown in FIG. 1 of the accompanying drawings.

1 Claim, 7 Drawing Figures

FERRITE-AUSTENITE STAINLESS STEEL CASTINGS HAVING AN IMPROVED EROSION-CORROSION RESISTANCE

BACKGROUND OF THE INVENTION

1. Field of the Invention:

The present invention relates to ferrite-austenite stainless steel castings having an improved erosion-corrosion resistance.

2. Description of the Prior Art:

Hitherto, stainless steel castings have widely been used as structural parts in machine and equipment for pollution prevention which are used in coke-sintering apparatus, copper refining apparatus, electric power apparatus, chemical plants, food processing equipment, marine related equipments and the like, for example, impeller, casing, front cover and valve of pumps for a wettype exhaust fume desulfurization system by lime-gypsum process. In such applications, however, it is known that the stainless steel castings are susceptible to erosion-corrosion in the presence of high-temperature and high-concentration sulfuric acid, sulfurous acid gas, chlorine and other halogen ions, sludge, clay, lime, gypsum and the like and also are susceptible to pitting corrosion due to the use of industrial water and sea water.

Recently, various stainless steel castings have been developed exhibiting a high corrosion resistance under the above mentioned severe conditions. For instance, the stainless steel castings JIS G 5121-SCS 11, SCS 14 (ASTM CF8M), Carpenter stainless No. 20 and Hastelloy C, which have a chemical composition shown in the following Table 1, are used as the material for structural parts of a pump.

Table 1

| Symbol of material | Chemical composition (%) | | | | | | | | |
|---|---|---|---|---|---|---|---|---|---|
| | C | Si | Mn | Cu | Ni | Cr | Mo | Co | W |
| JIS-SCS 11 | ≦0.10 | ≦1.50 | ≦1.00 | | 5.00 ~7.00 | 23.00 ~27.00 | 1.50 ~2.50 | | |
| JIS-SCS 14 | ≦0.08 | ≦1.50 | ≦2.00 | | 10.00 ~14.00 | 17.00 ~20.00 | 2.00 ~3.00 | | |
| Carpenter stainless No. 20 | ≦0.07 | ≦1.0 | ≦2.0 | | 24.0 ~30.0 | 19.0 ~21.0 | 2.0 ~3.0 | | |
| Hastelloy C | ≦0.12 | ≦1.0 | ≦1.0 | | bal. | 15.5 ~19.5 | 16.0 ~18.0 | ≦2.5 | 3.75 ~5.25 |

SCS 11 and SCS 14 are comparatively cheap, but are low in strength and poor in corrosion resistance, particularly erosion-corrosion resistance. On the other hand, Carpenter stainless No. 20 is good with respect to resistance to sulfuric acid, but is expensive, low in strength and poor with respect to pitting-corrosion resistance and erosion-corrosion resistance. Further, Hastelloy C displays a good corrosion resistance, but is expensive and low in strength. Therefore, these stainless steel castings are not yet satisfactory for the above mentioned applications and may cause serious problems during use.

SUMMARY OF THE INVENTION

An object of the present invention is to provide ferrite-austenite stainless steel castings which can effectively be used as the structural parts in pollution preventing machines and equipment, particularly pumps of the wet-type used in exhaust fume desulfurization systems under severe conditions and further, which are inexpensive and have high strength, excellent corrosion resistance (e.g. resistance to sulfuric acid, pitting corrosion resistance, etc.) and an improved erosion-corrosion resistance.

According to the present invention, there is provided a ferrite-austenite stainless steel casting having an improved erosion-corrosion resistance, consisting by weight percentage of not more than 0.1% of carbon, 0.2–3% of silicon, not more than 2% of manganese, 2.2–4% of copper, 3–9% of nickel, 20–30% of chromium, 2–6% of molybdenum, 0.08–0.25% of nitrogen, 0.12–0.3% of tin, 0–2% of niobium, 0–1% of titanium, 0–2% of tantalum, 0–1% of zirconium, 0–1.5% of vanadium and remainder of iron, said stainless steel casting being obtained by solution heat treatment at a temperature of 1,000–1,150° C in such a manner that chromium- and nickel-equivalents lie within an area represented by the area ABCD shown in FIG. 1 of the accompanying drawings.

BRIEF DESCRIPTION OF THE DRAWINGS

The invention will now be described in greater detail with reference to the accompanying drawings, wherein.

DETAILED DESCRIPTION OF PREFERRED EMBODIMENT

The inventors have already found ferrite-austenite stainless steel castings usable for a rotary body of a centrifugal separator having improved strength and corrosion resistance and filed as Japanese Patent Application No. 12,405/74, No. 48,108/74 and No. 43,621/75. Such stainless steel castings have substantially a chemical composition of not more than 0.06% of C, not more than 2% of Si, not more than 1% of Mn, 0.1–0.3% of N, 1–7% of Ni, 20–30% of Cr, not more than 3% of Cu, 0.5–6% of Mo, 0.0008–0.050% of B, at least one of 0.08–1.2% of Nb, 0.05–0.8% of Ti, 0.1–2% of Ta, 0.03–0.5% of Zr and 0.05–1.5% of Al, and remainder of Fe. However, it has been found that these stainless steel castings have good strength and corrosion resistance but are very poor in erosion-corrosion resistance when used as the structural parts under the severe conditions as described above.

Figure 1:
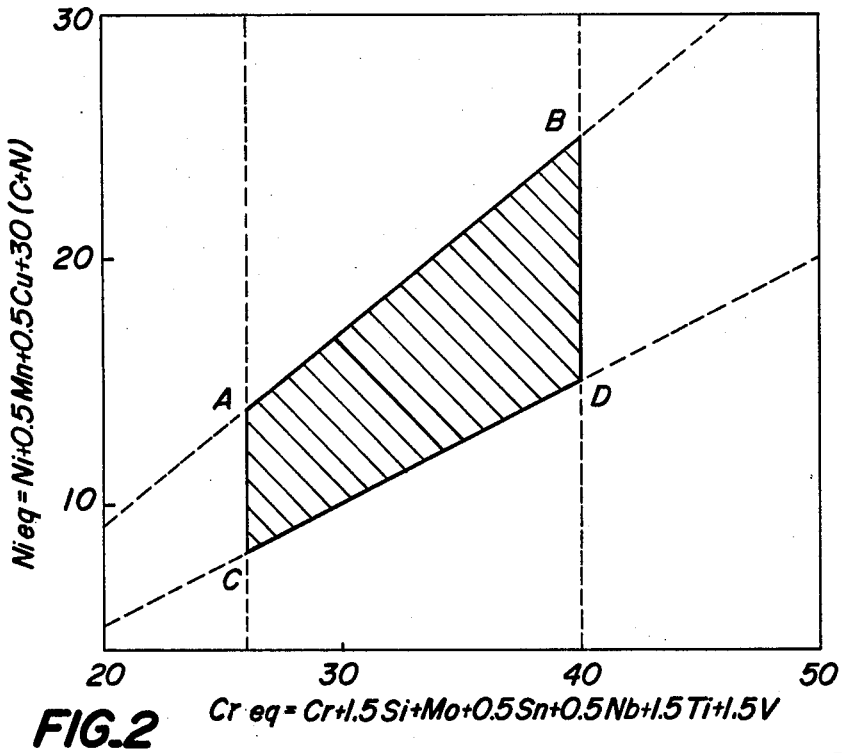
FIG. 1 is a graph showing chromium- and nickel-equivalents for obtaining an improved erosion-corrosion resistance in the stainless steel casting according to the present invention.

Now, the inventors have made further studies with respect to the above mentioned stainless steel castings and found that the ferrite-austenite stainless steel castings having the chemical composition as defined above and the chromium- and nickel-equivalents of the area ABCD shown in FIG. 1 exhibit the considerably improved erosion-corrosion resistance in addition to high strength and excellent corrosion resistance.

The ferrite-austenite stainless steel casting of the present invention has a chemical composition of not more than 0.1% of C, 0.2–3% of Si, not more than 2% of Mn, 2.2–4% of Cu, 3–9% of Ni, 20–30% of Cr, 2–6% of Mo, 0.08–0.25% of N, 0.12–0.3% of Sn, and if necessary, at least one of 0–2% of Nb, 0–1% of Ti, 0–2% of Ta, 0–1% of Zr and 0–1.5% of V, and the remainer being Fe and is obtained by solution heat treatment at a temperature of 1,000°–1,150° C in such a manner that chromium- and nickel-equivalents lie within an area represented by the area ABCD shown in FIG. 1 of the accompanying drawings.

According to the present invention, the reason for limiting the chemical composition of the stainless steel casting to the ranges as mentioned above is as follows:

(1) Carbon: not more than 0.1%

Carbon is a strong austenite stabilizing element. When carbon is added in an amount of more than 0.1%, however, a carbide $Cr_{23}C_6$ is precipitated and the corrosion resistance deteriorates.

(2) Silicon: 0.2–3%

Silicon acts as a deoxidizing agent during refining and improves the fluidity of the molten steel. For this purpose, silicon must to be added in an amount of at least 0.2%. However, when the content of silicon exceeds 3%, the casting exhibits brittleness at 475° C, the formation of $\sigma$-phase is promoted. (3) Manganese: not more than 2%

Manganese is an austenite stabilizing element and acts as a deoxidizing agent during refining. When manganese is added in an amount of more than 2%, however, corrosion resistance deteriorates and the formation of $\sigma$-phase is promoted.

(4) Copper: 2.2–4%

Copper is an austenite stabilizing element and improves the strength, corrosion resistance and erosion-corrosion resistance of basic iron matrix. When the content of copper is less than 2.2%, the addition effect is small, but when the content is more than 4%, hot tear cracks are caused and the formation of $\sigma$-phase is promoted.

(5) Nickel 3–9%

Nickel is a strong austenite stabilizing element, improving the corrosion resistance and toughness of the casting. For this purpose, nickel must to be added in an amount of at least 3%. The upper limit of nickel is 9% because nickel is expensive and the five-component balance of nickel, chromium, copper, molybdenum and nitrogen should be considered in order to provide the duplex structure of ferrite and austenite.

(6) Chromium: 20–30%

Chromium is a ferrite stabilizing element. In order to improve the corrosion resistance and provide the above mentioned duplex structive, it is necessary to employ a chromium content of at least 20% considering the five-component balance as described above. However, when the content of chromium is more than 30%, the five-component balance becomes unbalanced, so that brittleness of the casting is exhibited at 475° C and the formation of $\sigma$-phase is promoted.

(7) Molybdenum: 2–6%

Molybdenum is a ferrite stabilizing element and is effective for improving the corrosion resistance, particularly pitting-corrosion resistance. For this purpose, molybdenum is added in an amount of at least 2%. However, when the content of molybdenum is more than 6%, the formation of $\sigma$-phase is promoted brittleness is likely to result, and the cost becomes high.

(8) Nitrogen: 0.08–0.25%

Nitrogen is a strong austenite stabilizing element and is effective for improving the corrosion resistance and erosion-corrosion resistance. For this purpose, nitrogen should be added in an amount of at least 0.08%. However, when the content of nitrogen is more than 0.25%, casting defects such as blow hole and the like are likely to result.

(9) Tin: 0.12–0.3%

Tin is effective for improving the corrosion resistance and erosion-corrosion resistance. Therefore, tin should be added in an amount of at least 0.12%.

However, when the content of tin is more than 0.3%, the toughness deteriorates and intergranular segregation and brittleness are caused.

(10) Niobium: 0–2%, Titanium: 0–1%, Tantalum: 0–2%, Zirconium: 0–1%, Vanadium: 0–1.5%

These alloying elements are ferrite stabilizers, and serve to refine the grain, to improve the intergranular corrosion resistance and to suppress segregation. For this purpose, at least one of these alloying elements is added, in the indicated range, if necessary.

According to the present invention, confirmed by experiment, the erosion-corrosion resistance in a stainless steel casting having the above chemical composition is influenced considerably by the resulting structure, i.e. ferrite percentage to austenite percentage. This ferrite percentage to austenite percentage depends upon the chromium- and nickel-equivalents in the stainless steel casting and a relationship between them is shown as a Schaeffler phase diagram in FIG. 1.

In this figure, the abscissa represents the chromium equivalent [Cr eq. $=Cr+1.5Si+\lambda Mo+0.5Sn+0.5Nb+1.5Ti+1.5V$], and the ordinate represents the nickel equivalent [Ni eq. $=Ni+0.5Mn+0.5Cu+30(C+N)$]. Link AB shows that the ferrite percentage is 40% after solution heat treatment at a temperature of 1,000–1,150° C, and line CD shows the ferrite percentage to be 80%. Further, line AC shows a chromium equivalent of 26 and line BD shows a chromium equivalent of 40.

When the chromium equivalent is less than 26, the concentrations of Cr, Mo and the like, the ferrite stabilizing elements, are low, so that not only erosion-corrosion resistance but also corrosion resistance deteriorate.

On the other hand, when the chromium equivalent is more than 40, the σ-phase is formed, the erosion-corrosion resistance is considerably decreased, and further, cracks and brittleness are likely to result in the course of the production.

When the ferrite percentage is less than 40%, the strength and wear resistance are lowered and the erosion-corrosion resistance deteriorates. On the other hand, when the ferrite percentage is more than 80%, grain coarsening of the stainless steel casting is considerably promoted, so that toughness deteriorates and cracks are likely to result in the course of production.

As seen from the above, in order to obtain a ferrite-austenite stainless steel casting having an improved erosion-corrosion resistance, it is essential that the solution heat treatment be effected at a temperature of 1,000°-1,150° C in such a manner that the chromium- and nickel-equivalents lie within the area represented by the area ABCD shown in FIG. 1. In FIG. 1, symbol A represents a point of Cr eq.=26 and Ni eq.=14, symbol B a point of Cr eq.=40 and Ni eq.=25, symbol C the point where Cr eq.=26 and Ni eq.=8, and symbol D the point where Cr eq.=40 and Ni eq.=15.

In the solution heat treatment, when the temperature is less than 1,000° C, the σ-phase is formed and the corrosion resistance, toughness and the like deteriorate. On the other hand, when the temperature is more than 1,150° C, the ferrite percentage increases, so that the grain of the stainless steel casting is coarsened and other properties such as castability, machinability and the like deteriorate and hot tear cracks are likely to result. Therefore, the solution heat treatment should be suitable for a temperature of 1,000°-1,150° C.

The following examples are given only as an illustration of the present invention and are not intended a limitation thereof.

EXAMPLES

Stainless steel castings having chemical compositions shown in the following Table 2 were produced by solution heat treatment at a temperature of 1,080° C for 30 minutes according to JIS boat-type No. A method. In Table 2, specimens No. 1-9 are the stainless steel castings of the present invention and specimens No. 10-18 are references beyond the scope of the present invention. For comparison, the conventional stainless steel castings, i.e. SCS 11, Carpenter stainless No. 20 and Hastelloy C are also shown in Table 2 as specimens No. 16-18, respectively.

Table 2

| | Specimen No. | Chemical composition (wt.%) | | | | | | | | | | | | | | |
|---|---|---|---|---|---|---|---|---|---|---|---|---|---|---|---|---|
| | | C | Si | Mn | Cu | Ni | Cr | Mo | N | Sn | Nb | Ti | V | Co | W | Fe |
| Present invention | 1 | 0.07 | 0.63 | 0.73 | 3.13 | 6.16 | 26.43 | 2.69 | 0.10 | 0.14 | | | | | | bal. |
| | 2 | 0.04 | 0.62 | 0.72 | 4.32 | 6.51 | 26.24 | 2.63 | 0.09 | 0.15 | | | | | | " |
| | 3 | 0.06 | 0.78 | 0.68 | 2.99 | 6.31 | 26.15 | 2.91 | 0.13 | 0.15 | | | | | | " |
| | 4 | 0.07 | 0.72 | 0.69 | 3.23 | 6.18 | 26.23 | 3.02 | 0.21 | 0.17 | | | | | | " |
| | 5 | 0.05 | 0.58 | 0.66 | 2.89 | 6.44 | 26.44 | 2.51 | 0.16 | 0.13 | | | | | | " |
| | 6 | 0.03 | 0.74 | 0.60 | 3.11 | 6.52 | 26.31 | 2.46 | 0.15 | 0.26 | | | | | | " |
| | 7 | 0.06 | 2.72 | 1.20 | 2.44 | 8.48 | 28.95 | 4.37 | 0.21 | 0.15 | 0.32 | — | — | | | " |
| | 8 | 0.07 | 1.46 | 1.52 | 2.96 | 4.21 | 29.30 | 5.10 | 0.11 | 0.18 | 1.22 | 0.52 | — | | | " |
| | 9 | 0.06 | 0.45 | 0.84 | 3.82 | 7.63 | 23.72 | 4.82 | 0.15 | 0.21 | — | 1.24 | 0.46 | | | " |
| Reference | 10 | 0.05 | 0.61 | 0.77 | 0.94 | 6.36 | 26.76 | 2.57 | 0.11 | 0.14 | | | | | | " |
| | 11 | 0.06 | 0.68 | 0.56 | 2.18 | 6.19 | 26.35 | 2.62 | 0.10 | 0.13 | | | | | | " |
| | 12 | 0.06 | 0.82 | 0.73 | 3.07 | 6.15 | 26.54 | 3.11 | 0.04 | 0.15 | | | | | | " |
| | 13 | 0.06 | 0.70 | 0.74 | 2.88 | 6.23 | 26.53 | 2.86 | 0.07 | 0.16 | | | | | | " |
| | 14 | 0.06 | 0.75 | 0.69 | 2.82 | 5.64 | 25.88 | 2.78 | 0.16 | — | | | | | | " |
| | 15 | 0.04 | 0.54 | 0.86 | 2.96 | 6.66 | 26.27 | 2.70 | 0.18 | 0.34 | | | | | | " |
| | 16 | 0.08 | 1.10 | 0.77 | 0.09 | 6.13 | 25.64 | 1.75 | 0.04 | — | — | — | — | | | " |
| Prior art | 17 | 0.06 | 0.72 | 1.15 | 3.11 | 28.52 | 19.32 | 2.01 | — | — | | | | | | " |
| | 18 | 0.08 | 0.97 | 0.52 | — | bal. | 15.82 | 17.11 | — | — | | | 0.32 | 2.11 | 4.15 | 5.26 |

Note:
Specimen No. 16: JIS G 5121-SCS 11
Specimen No. 17: Carpenter stainless No. 20
Specimen No. 18: Hastelloy C The mechanical properties, corrosion resistance and erosion-corrosion resistance were measured with respect to the above stainless steel castings to obtain results as shown in the following Table 3.

Table 3

| Specimen No. | | Mechanical properties *1 | | | | Corrosion resistance (weight loss) | | |
|---|---|---|---|---|---|---|---|---|
| | | 0.2% Proof stress ($kg/mm^2$) | Tensile strength ($kg/mm^2$) | Elongation (%) | Brinell hardness (BHN) | 5%$H_2SO_4$ in boiling, 6hr. *2 ($g/m^2 \cdot hr$) | 50g$FeCl_3$ $6H_2O$/l, 35° C, 48 hr. *3 ($mg/cm^2$) | (5%$H_2SO_4$+5000ppm $Cl^-$ + 2000ppm$SO_2$)5l + 50 mesh silica sand 1200g + 325mesh gypsum 200g, 60° C, rotating speed 6m/sec., 48 hr. *4 ($g/m^2 \cdot hr$) |
| Present invention | 1 | 65.2 | 81.5 | 17.8 | | 1.82 | 0.52 | 0.46 |
| | 2 | 69.6 | 83.4 | 16.5 | | 1.80 | 0.45 | 0.42 |
| | 3 | 66.9 | 84.7 | 17.6 | | 1.62 | 0.39 | 0.39 |
| | 4 | 65.0 | 86.8 | 19.4 | | 1.53 | 0.38 | 0.41 |
| | 5 | 63.4 | 80.4 | 18.9 | | 1.76 | 0.40 | 0.40 |
| | 6 | 65.9 | 83.6 | 13.2 | | 1.45 | 0.32 | 0.38 |
| | 7 | 67.4 | 87.8 | 16.8 | | 0.95 | 0.24 | 0.28 |
| | 8 | 65.8 | 82.7 | 17.5 | | 1.93 | 0.61 | 0.46 |
| | 9 | 62.7 | 81.9 | 21.8 | | 1.25 | 0.29 | 0.43 |
| Reference | 10 | 58.4 | 77.6 | 23.3 | | 2.11 | 2.44 | 1.52 |
| | 11 | 59.8 | 80.1 | 19.6 | | 1.98 | 1.08 | 0.84 |
| | 12 | 65.4 | 82.3 | 15.7 | | 1.90 | 4.02 | 3.81 |
| | 13 | 66.4 | 82.3 | 17.3 | | 1.43 | 1.73 | 0.76 |
| | 14 | 64.9 | 80.8 | 18.2 | | 1.88 | 6.02 | 0.95 |
| | 15 | 63.6 | 81.6 | 18.7 | | 1.51 | 0.16 | 0.32 |
| | 16 | 50.6 | 67.7 | 21.2 | | 3.05 | 9.64 | 38.50 |
| Prior | 17 | 21.9 | 49.9 | 53.9 | 133 | 1.75 | 6.0 | 35.0 |

Table 3-continued

| Specimen No. | | Mechanical properties *1 | | | | Corrosion resistance (weight loss) | | |
|---|---|---|---|---|---|---|---|---|
| | | 0.2% Proof stress ($kg/mm^2$) | Tensile strength ($kg/mm^2$) | Elongation (%) | Brinell hardness (BHN) | $5\%H_2SO_4$ in boiling, 6hr. *2 ($g/m^2 \cdot hr$) | $50gFeCl_3 \cdot 6H_2O/l$, 35° C, 48 hr. *3 ($mg/cm^2$) | ($5\%H_2SO_4$+5000ppm $Cl^-$ + 2000ppm$SO_2$)5l + 50 mesh silica sand 1200g + 325mesh gypsum 200g, 60° C, rotating speed 6m/sec., 48 hr. *4 ($g/m^2 \cdot hr$) |
| art | 18 | 32.9 | 60.3 | 14.1 | 210 | 0.6 | 0.5 | 1.5 |

Note:
*1: JIS No. 4 (test piece)
*2: JIS G-0591 (General corrosion test)
*3: Pitting corrosion test
*4: Erosion-corrosion test As seen from the results of Table 3, the stainless steel castings of the present invention have excellent corrosion resistance and erosion-corrosion resistance as compared with the SCS 11, Carpenter stainless No. 20 and Hastelloy C and are high in strength; the 0.2% proof stress is more than 60 $kg/mm^2$.

Figure 2:
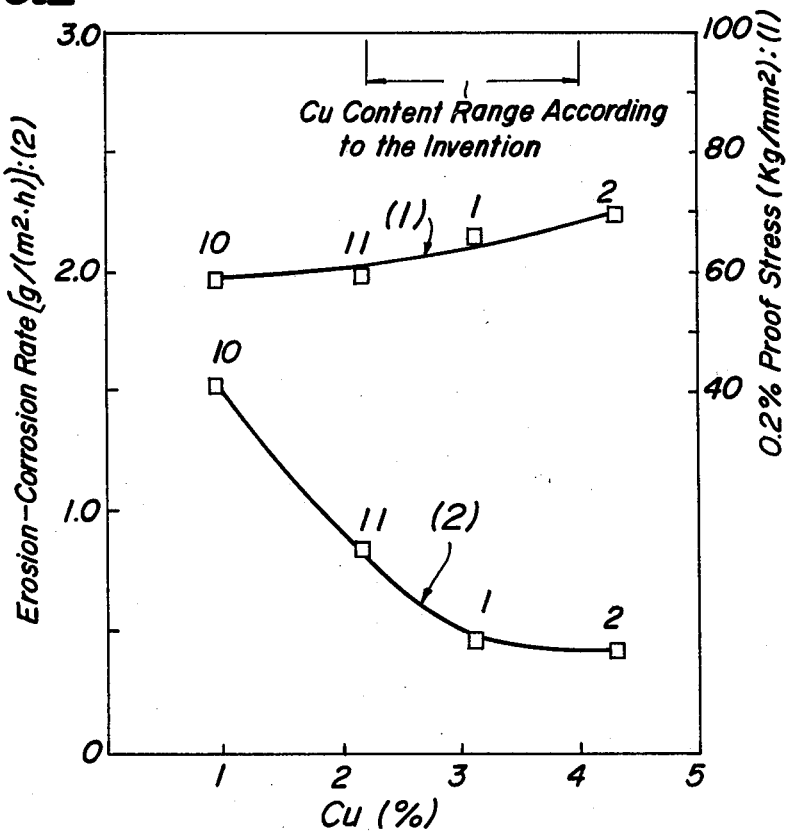
FIG. 2 is a graph showing the influence of copper content on erosion-corrosion resistance and proof stress in the stainless steel casting according to the present invention.
Figure 3:
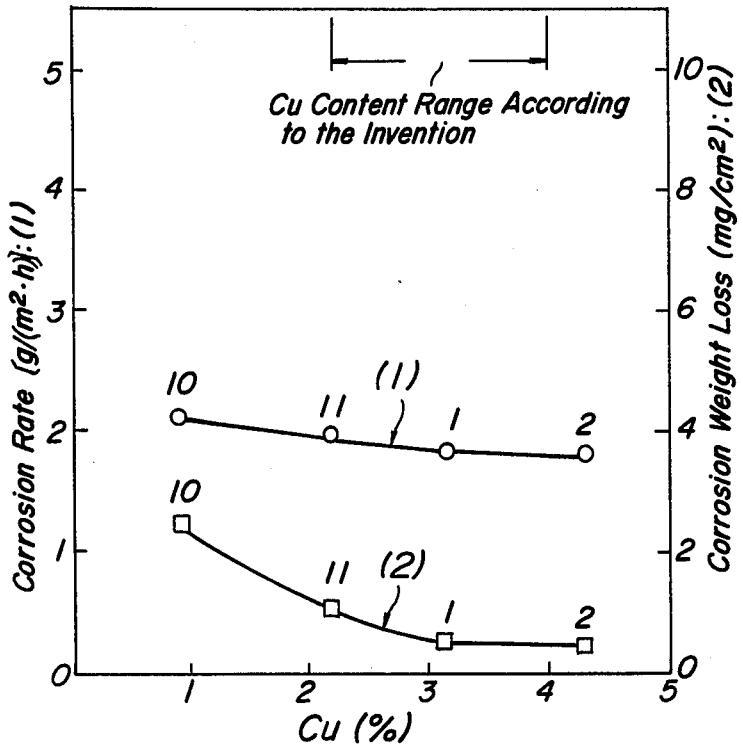
FIG. 3 is a graph showing the influence of copper content on general corrosion rate in boiling 5% $H_2SO_4$ and corrosion weight loss for pitting corrosion in the stainless steel casting according to the present invention.

In the stainless steel casting of the present invention, the influence of the copper content on the strength, corrosion resistance and erosion-corrosion resistance is described in detail with reference to FIGS. 2 and 3. FIG. 2 shows a 0.2% proof stress curve (1) and an erosion-corrosion resistance curve (2) for specimens No. 1, 2, 10 and 11 when tested in (5% $H_2SO_4$ + 5,000 ppm $Cl^-$ + 2,000 ppm $SO_2$)5l + 50 mesh silica sand 1,200 g + 325 mesh gypsum 200 g at a temperature of 60° C and a rotating speed of 6 m/sec for 48 hours. In FIG. 3, curve (1) shows the results of a general corrosion test in boiling 5% $H_2SO_4$ for 6 hours for specimens No. 1, 2, 10 and 11, and curve (2) shows the results of a pitting corrosion test in 50 g/l of $FeCl_3.6H_2O$ at 35° C for 48 hours for the same specimens. As seen from FIGS. 2 and 3, the strength, corrosion resistance and erosion-corrosion resistance are improved by increasing the copper content.

Figure 5:
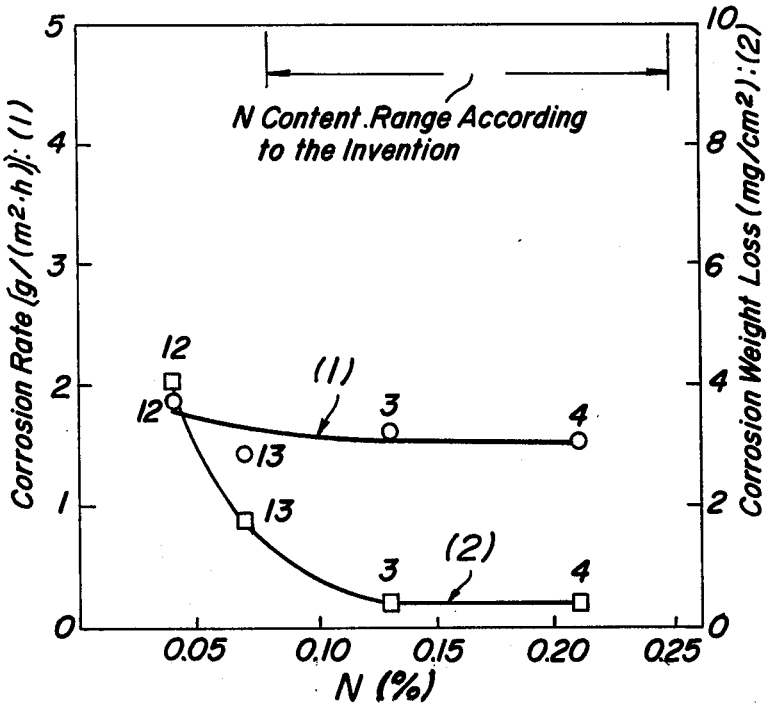
FIG. 5 is a graph showing the influence of nitrogen content on general corrosion rate in boiling 5% $H_2SO_4$ and corrosion weight loss for pitting corrosion in the stainless steel casting according to the present invention.
Figure 4:
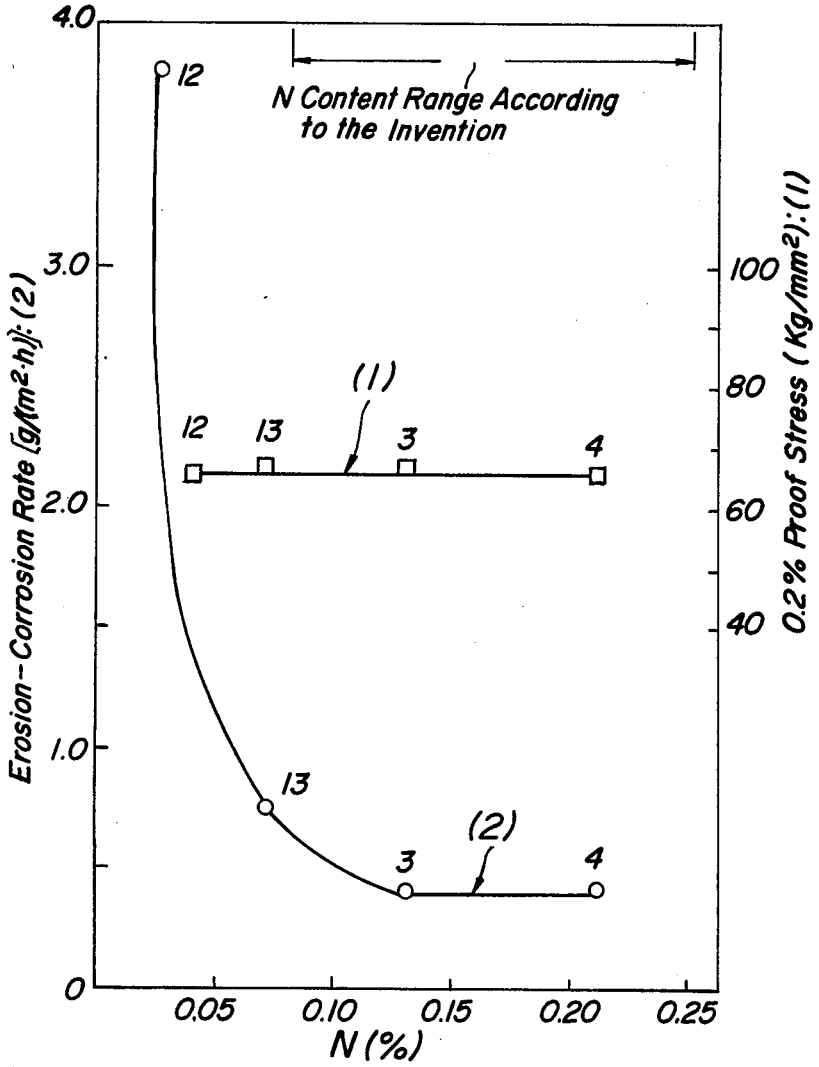
FIG. 4 is a graph showing the influence of nitrogen content on erosion-corrosion resistance and proof stress in the stainless steel casting according to the present invention.

In the stainless steel casting of the present invention, the influence of the nitrogen content on the strength, corrosion resistance and erosion-corrosion resistance is described in detail with reference to FIGS. 4 and 5. FIG. 4 shows a 0.2% proof stress curve (1) and an erosion-corrosion resistance curve (2) for specimens No. 3, 4, 12 and 13 when tested in (5% $H_2SO_4$ + 5,000 ppm $Cl^-$ + 2,000 ppm $SO_2$)5l + 50 mesh silica sand 1,200 g + 325 mesh gypsum 200 g at a temperature of 60° C and a rotating speed of 6 m/sec for 48 hours. In FIG. 5, curve (1) shows the results of a general corrosion test in boiling 5% $H_2SO_4$ for 6 hours for specimens No. 3, 4, 12 and 13, and curve (2) shows the results of a pitting corrosion test in 50 g/l of $FeCl_3.6H_2O$ at 35° C for 48 hours for the same specimens. As seen from FIGS. 4 and 5, the corrosion resistance and erosion-corrosion resistance are improved with increasing nitrogen content.

Figure 6:
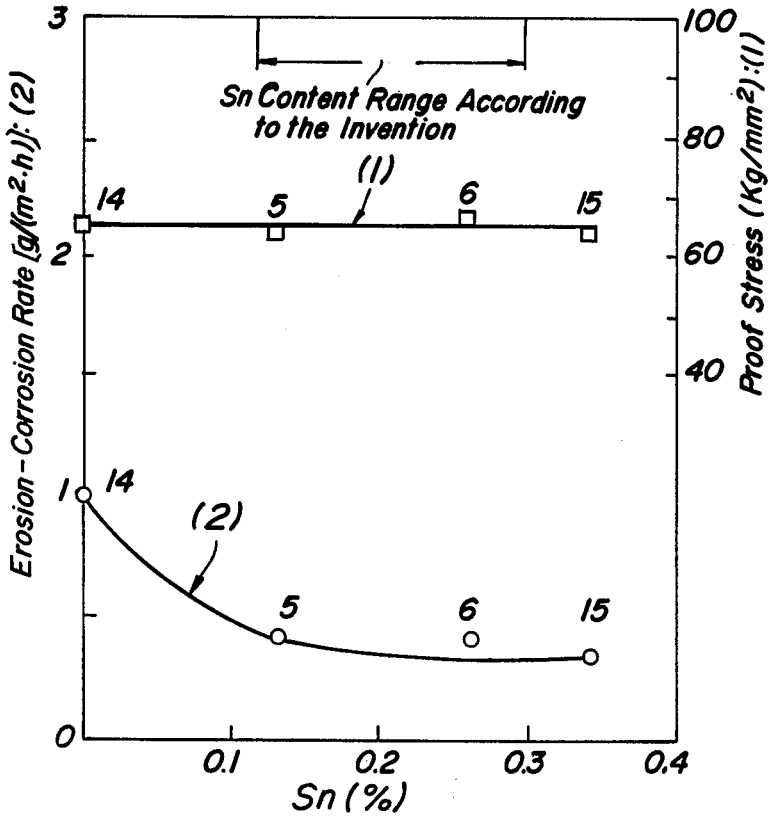
FIG. 6 is a graph showing the influence of tin content on erosion-corrosion resistance and proof stress in the stainless steel casting according to the present invention.
Figure 7:
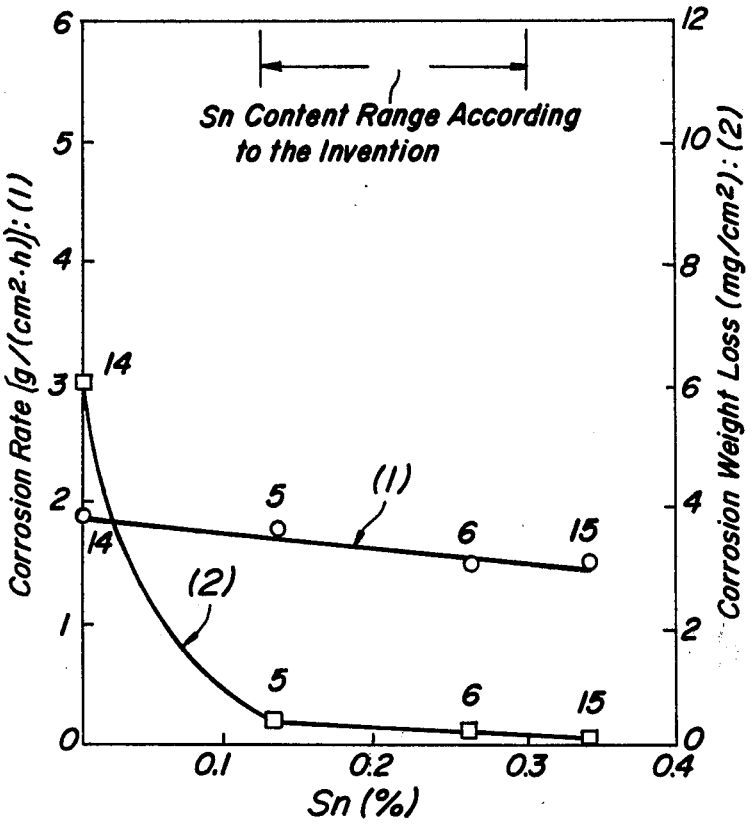
FIG. 7 is a graph showing the influence of tin content on general corrosion rate in boiling 5% $H_2SO_4$ and corrosion weight loss for pitting corrosion in the stainless steel casting according to the present invention.

In the stainless steel casting of the present invention, the influence of the tin content on the strength, corrosion resistance and erosion-corrosion resistance is described in detail with reference to FIGS. 6 and 7. FIG. 6 shows a 0.2% proof stress curve (1) and an erosion-corrosion resistance curve (2) for specimens No. 5, 6, 14 and 15 when tested in (5% $H_2SO_4$ + 5,000 ppm $Cl^-$ + 2,000 ppm $SO_2$)5l + 50 mesh silica sand 1,200 g + 325 mesh gypsum 200 g at a temperature of 60° C and a rotating speed of 6 m/sec for 48 hours. In FIG. 7, curve (1) shows the results of general corrosion test in boiling 5% $H_2SO_4$ for 6 hours for specimens No. 5, 6, 14 and 15, and curve (2) shows the results of a pitting corrosion test in 50 g/l of $FeCl_3.6H_2O$ at 35° C for 48 hours for same specimens. As seen from FIGS. 6 and 7, the corrosion resistance and erosion-corrosion resistance are improved increasing tin content.

As mentioned above, the ferrite-austenite stainless steel castings of the present invention have improved corrosion resistance and erosion-corrosion resistance and high strength, so that they are most suitable for use as structural parts in pollution prevention machines and equipment requiring an erosion-corrosion resistance, particularly in in pumps used in wet-type exhaust fume desulfurization system employing a lime-gypsum process.

What is claimed is:

1. A ferrite-austenite stainless steel casting having an improved erosion-corrosion resistance, consisting by weight percentage of not more than 0.1% of carbon, 0.2–3% of silicon, not more than 2% of manganese, 2.2–4% of copper, 3–9% of nickel, 20–30% of chromium, 2–6% of molybdenum, 0.08–0.25% of nitrogen, 0.12–0.3% of tin, 0–2% of niobium, 0–1% of titanium, 0–2% of tantalum, 0–1% of zirconium, 0–5% of vanadium and remainder of iron; said stainless steel casting being obtained by solution heat treatment at a temperature of 1,000–1,150° C in such a manner that chromium- and nickel-equivalents lie within an area represented by the area ABCD shown in FIG. 1 of the accompanying drawings.

* * * * *